United States Patent [19]

Olschansky et al.

[11] Patent Number: 5,074,551

[45] Date of Patent: Dec. 24, 1991

[54] MULTI-EXERCISE SYSTEM

[75] Inventors: Brad Olschansky, Baltimore; Scott Olschansky, Towson; Raymond H. Lee, Jr., Lutherville, all of Md.

[73] Assignee: Lifeing, Inc., Pikesville, Md.

[21] Appl. No.: 534,878

[22] Filed: Jun. 8, 1990

[51] Int. Cl.[5] ..... A63B 21/04

[52] U.S. Cl. ..... 272/136; 272/134

[58] Field of Search ..... 272/116–118, 272/134–143

[56] References Cited

U.S. PATENT DOCUMENTS

| | | | |
|---|---|---|---|
| 4,231,568 | 11/1980 | Riley et al. | 272/136 |
| 4,311,305 | 1/1982 | Lambert, Jr. et al. | 272/134 X |
| 4,322,071 | 3/1982 | Lambert, Jr. et al. | 272/118 |
| 4,349,192 | 9/1982 | Lambert, Jr. et al. | 272/118 |
| 4,349,193 | 9/1982 | Lambert, Jr. et al. | 272/118 |
| 4,349,194 | 9/1982 | Lambert, Jr. et al. | 272/118 |
| 4,465,274 | 8/1984 | Davenport | 272/134 X |
| 4,621,807 | 11/1986 | Stramer | 272/117 |
| 4,666,149 | 5/1987 | Olschansky et al. | 272/134 X |
| 4,666,151 | 5/1987 | Chillier | 272/136 X |
| 4,784,384 | 11/1988 | Deola | 272/134 X |
| 4,902,006 | 2/1990 | Stallings, Jr. | 272/118 |

*Primary Examiner*—Robert Bahr

*Attorney, Agent, or Firm*—Morton J. Rosenberg; David I. Klein

[57] ABSTRACT

A multi-exercise system (10) is provided to actuate a resistive force loading responsive to an implied force by a user. A rotational actuation mechanism (84) is provided for bi-directional rotation about a singular axis (16) and coupled to an upper carriage (42) of resistive force mechanism (40). The rotational actuation mechanism (84) provides an initial rotative displacement in either of two opposite directions which is transformed into a linear displacement of the resistive force loading members (72). The rotational actuation mechanism (84) may include a sprocket wheel 86 whose rotative axis (16') is displaced from the sprocket wheel center (87') for compensating for the change in load force as the elastic cord members (72) are stretched.

20 Claims, 7 Drawing Sheets

MULTI-EXERCISE SYSTEM

BACKGROUND OF THE INVENTION

1. Field of the Invention

This invention is directed to an improved multi-exercise system. Particularly, this invention is directed to an improved multi-exercise system wherein the user may exercise different portions of his or her body and allows adjustability of the system to facilitate differing physical characteristics of the user. Still further, this invention is directed to an improved multi-exercise system which includes a rotatively actuated bar mechanism utilized in combination with a rotational actuation mechanism rotatable about a singular axis from an initial position to a second position disposed in either of two opposite directions. Additionally, this invention is directed to a multi-exercise system which includes a resistive force mechanism adjustable and fixedly securable to a pair of vertically directed bar frame members. Further, this invention relates to an improved multi-exercise system where the rotational actuation mechanism is coupled to a resistive force mechanism by a pair of flexible members, each coupled on one end to opposing sides of a rotative displacement member, and coupled on the opposing end to a resistive force upper carriage member for linear displacement thereof responsive to rotation of the rotative displacement member. More in particular, this invention pertains to the improved multi-exercise system where the flexible members are maintained at a minimum predetermined tension by a tensioning system.

2. Prior Art

Exercise systems using rotational actuation mechanisms for linearly displacing a resistive force loading are well known in the art. The best prior art known to the Applicants include U.S. Pat Nos. 1,028,956; 2,777,439; 2,855,199; 3,374,675; 3,647,209; 3,708,116; 3,721,438; 3,912,263; 4,208,049; 4,226,414; 4,226,415; 4,240,626; 4,275,882; 4,317,566; 4,328,964; 4,407,495; 4,478,411; 4,492,375; 4,500,089; 4,546,971; 4,568,078; 4,600,189; 4,600,196; and, 4,666,149, and Netherlands Patent #8005681.

Some prior art systems, such as that shown in Applicants' prior U.S. Pat. No. 4,666,149, show a multi-exercise system providing a resistive force by linear displacement of a resistive force mechanism responsive to a rotational actuation force applied by the user. However, the coupling between the rotational actuation mechanism and the linearly displaceable resistive force mechanism is made by a single flexible member. While the use of a singular flexible member for coupling between the rotational actuation mechanism and resistive force mechanism permits bi-directional operation from an initial position to either of two oppositely directed postions, such creates a dead zone. The linear displacement of the resistive force mechanism is not linearly proportional to the rotative displacement of the rotational actuation mechanism during the initial displacement thereof. Thus, the actuation arm must be rotated through a predetermined number of angular degrees before significant linear displacement of the resistive force mechanism occurs. Whereas in the instant invention a pair of flexible members are utilized and coupled to the rotative displacement mechanism to provide both bi-directional movement and linear displacement of the resistive force mechanism with respect to rotation of the actuation arm throughout the total rotative displacement thereof.

SUMMARY OF THE INVENTION

An improved multi-exercise system of the type having at least one resistance element reversibly displaceable responsive to rotative displacement of an actuating bar mechanism. The improved multi-exercise system includes a mechanism for bi-directionally coupling the actuating bar mechanism to the resistive element. The bi-directional coupling mechanism includes (1) a rotative displacement element coupled to the actuating bar mechanism for rotation about the rotative axis of the rotative displacement element from a first position to either of two oppositely directed second positions responsive to respective displacement of the actuating bar mechanism, and (2) a pair of flexible elements fixedly coupled to the opposing sides of the rotative displacement element on respective first ends thereof. Each of the pair of flexible elements includes a second end coupled to the resistive element, whereby an initial rotative displacement of the rotative displacement element in either of two opposite directions is transformed into a linear displacement of the resistive element.

DESCRIPTION OF THE PREFERRED EMBODIMENTS

Figure 1:
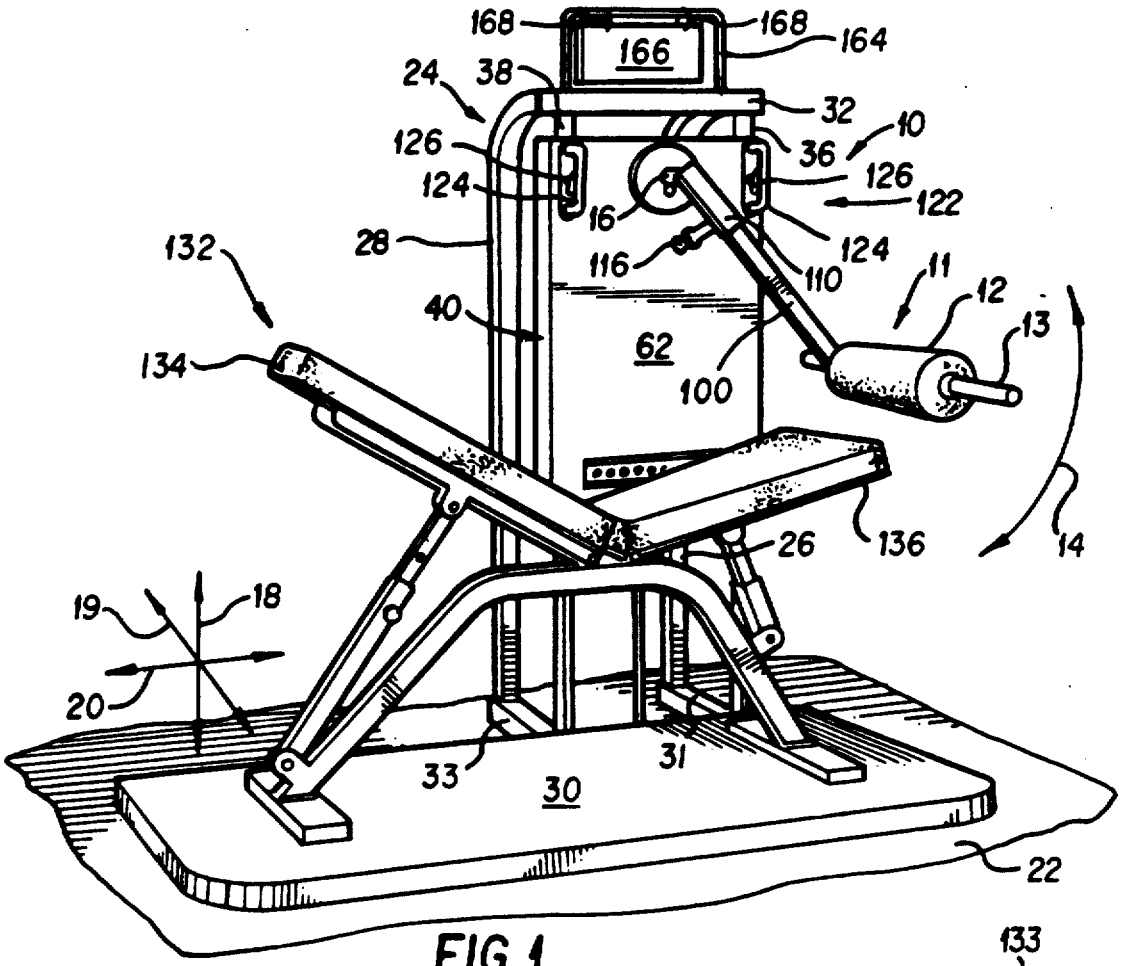
FIG. 1 is a perspective view of the improved multi-exercise system.
Figure 2:
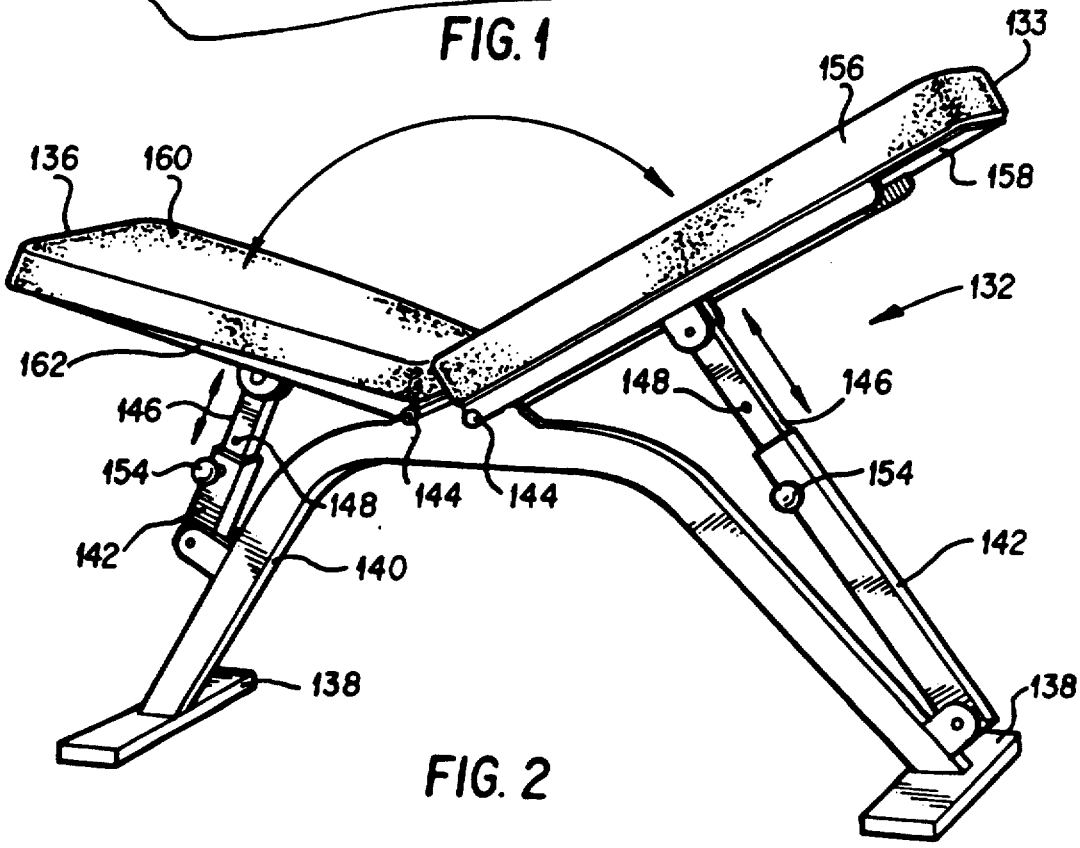
FIG. 2 is a perspective view of the adjustable seating mechanism of the improved multi-exercise system.
Figure 3:
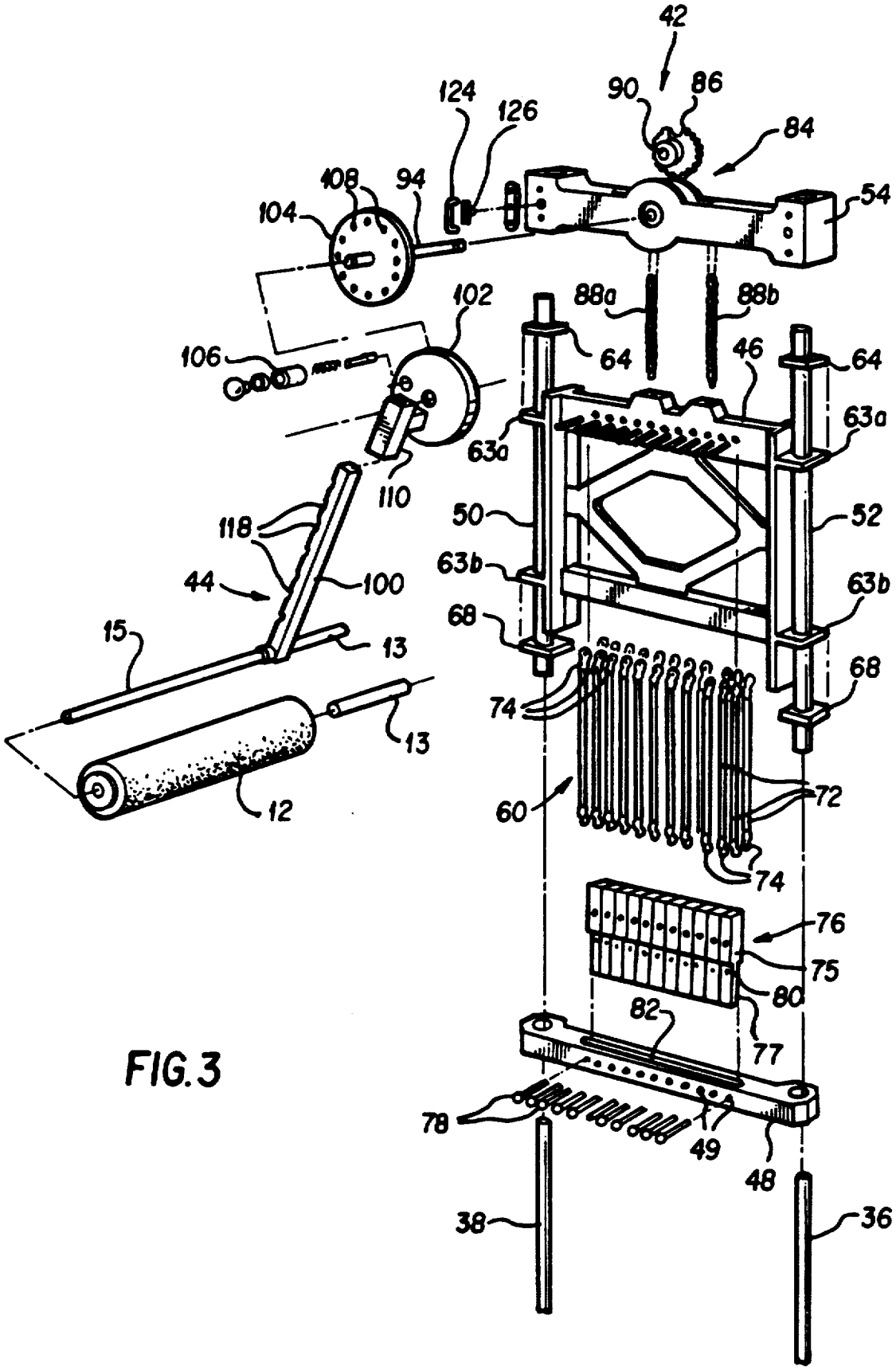
FIG. 3 is an exploded view of the transmission and resistive force mechanisms of the improved multi-exercise system.

Referring now to FIGS. 1-3, there is shown improved multi-exercise system 10 for providing a resistive force loading responsive to an applied force by a user. In overall concept, improved multi-exercise system 10 allows the user to apply a rotational displacement in either of two opposite directions to the handle mechanism 11, as shown in FIGS. 1, 3, and 10-13, in either clockwise or counterclockwise directions as indicated by arcuate directional arrow 14. Through this displacement, as will be seen in following paragraphs, the rotational displacement of handle mechanism 11 in either clockwise or counterclockwise directions results in a rotational to linear displacement conversion which acts on a resistive force within the system to provide exercise for the user.

Further, improved system 10 is directed in general concept to an exercising mechanism which provides for a wide variety of exercises for the user and further allows adjustability in the mechanism to increase the number of exercises and the applicability to a wide range of user physical characteristics. Still further, improved multi-exercise system 10 simplifies the adjustment of the mechanism in adapting to a wide range of exercises in its ability to linearly displace the resistive force mechanism 40 without a dead spot by a rotative displacement of the handle mechanism 11 in either a clockwise or counterclockwise direction with respect to an initial starting position, as opposed to prior art systems such as that disclosed in U.S. Pat. No. 4,666,149, incorporated herein by reference.

Improved multi-exercise system 10 includes a base frame 24 for interfacing with a base surface 22 so as to provide a stable platform upon which the working mechanisms of system 10 may be actuated. Base frame 24 may include a pair of lower frame cross bars 31 and 33 which extend in transverse direction 19 and contiguously interface with base surface 22. Arcuate rear structural members 26 and 28 extend from and are coupled to lower frame cross bars 31 and 33, respectively, extending in a vertical direction 18 for coupling with the upper frame cross bar 32 which extends in longitudinal direction 20. Lower frame cross bar members 31 and 33 extend in transverse direction 19 for coupling with base platform 30 which extends longitudinally in longitudinal direction 20. Structural members 26, 28, 30, 31, 32 and 33 are coupled respectively to each other through structural bolts, welding or some like fastening system, however, such is not important to the inventive concept as herein described, with the exception that the associated structural members are coupled each to the other in a substantially rigid manner and have sufficient structural integrity to accept the structural loads imposed thereon.

Structural members 26, 28, 30, 31, 32, and 33 may be formed from metallic channels, tubing, angle-irons, or some like configuration not important to the inventive concept as herein described. Additionally, the base platform 30 may be releasably coupled to one or both of lower frame cross bars 31 and 33 on one end thereof, and extend longitudinally therefrom. Base platform 30 provides a stable surface from which exercises may be performed and for support of the adjustable seating mechanism 132.

Referring now to FIGS. 1, 3, 4 and 5, there are shown base bar frame members 36 and 38 extending in vertical direction 18 and displaced each from the other in longitudinal direction 20. Base bar frame members 36 and 38 provide adjustable support for the resistive force mechanism 40, as will be described in following paragraphs. Base bar frame members 36 and 38, as seen in FIG. 1, are secured to respective lower frame cross bars 31 and 33 on one end thereof and secured on the opposing ends to opposing sides of upper frame cross bar 32. Frame members 36 and 38 may be formed of a cylindrically shaped tubing having sufficient structural integrity for supporting the mechanical loads imposed thereon.

Figure 10:
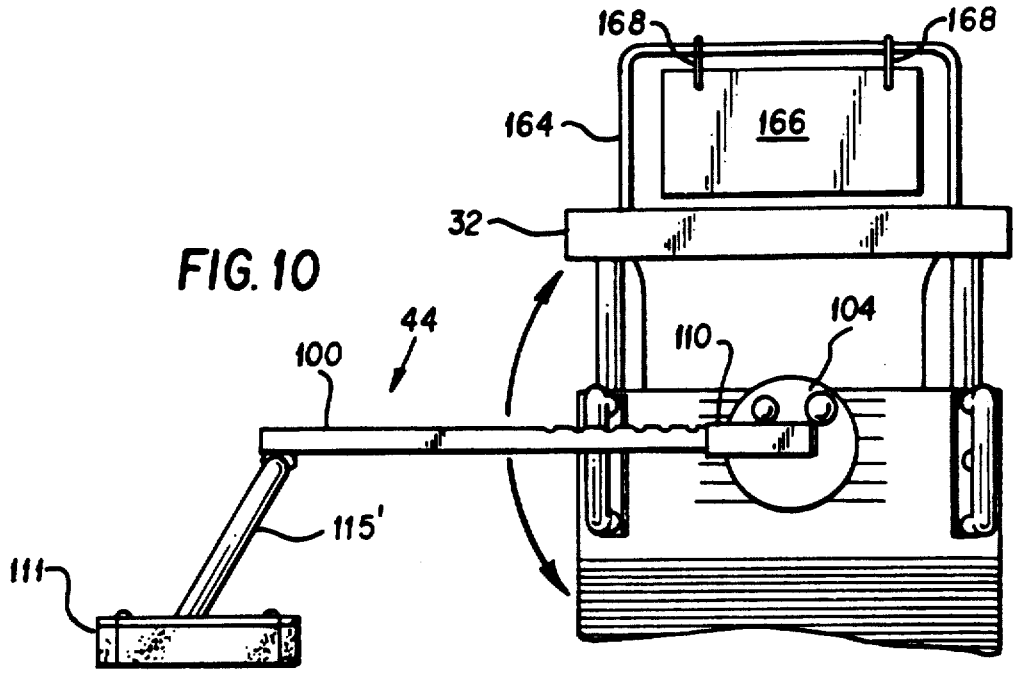
FIG. 10 is a frontal view partially in cut-away of the multi-exercise system illustrating the coupling of the actuating bar mechanism.

As shown in FIGS. 1 and 10, base frame 24 includes a substantially U-shaped tubular frame member 164 coupled to upper frame cross bar 32. Suspended from frame member 164 there is provided an instructive manual 166 for illustrating the use of system 10 for various exercises. Instructive manual 166 may be coupled to frame member 164 with ring shaped fastening elements 168, the rings 168 allowing the pages of manual 166 to be flipped up to expose underlying pages.

Referring now to FIGS. 1, 3, 4, 5 and 9, there is shown resistive force mechanism 40 which is adapted to be fixedly secured to base bar frame members 36 and 38, as well as being displaceable with respect thereto. Resistive force mechanism 40 includes a transmission mechanism for transferring the rotative displacement force applied to handle mechanism 11 into a linear displacement of the resistive force upper carriage or frame 46 relative to the resistive force lower frame 48. The transmission mechanism 42 includes a rotative displacement frame member 54 which is fixedly coupled to both resistive force tubular members 50 and 52, which pass around and are slideably displaceable with respect to the base bar frame members 36 and 38. Tubular members 50 and 52 pass in vertical direction 18 to resistive force lower frame member 48, where such is fixedly coupled, thereby allowing rotative displacement frame member 54 and resistive force lower frame member 48 to remain in fixed spaced relationship, each with respect to the other, but being slideably displaceable as a unit with respect to the base platform 30.

In this manner, it is seen that a vertical displacement in direction 18 of rotative displacement frame member 54 is transmitted through resistive force tubular members 50 and 52 and correspondingly and responsively, displaces resistive force lower frame member 48. Rotative displacement frame member 54 and resistive force lower frame member 48 slidingly or otherwise displacingly pass over the base bar frame members 36 and 38, with resistive force upper carriage 46 being displaced therewith by virtue of its coupling to rotative displacement frame member 54 by means of the rotative displacement mechanism 84.

Resistive force mechanism 40 further includes housing member 62 secured to resistive force tubular members 50 and 52 for relative displacement therewith. Housing member 62 provides an enclosure for rotative displacement mechanism 84, rotative displacement frame member 54, resistive force upper carriage 46, resistive force lower frame member 48 and the resistive load system 60. Such total and complete enclosure allows for the safe operation of the exercise mechanism, preventing the user from coming in contact with the displaceable elements of the system, thereby protecting the system from damage and protecting the user from potential injury.

Figure 5:
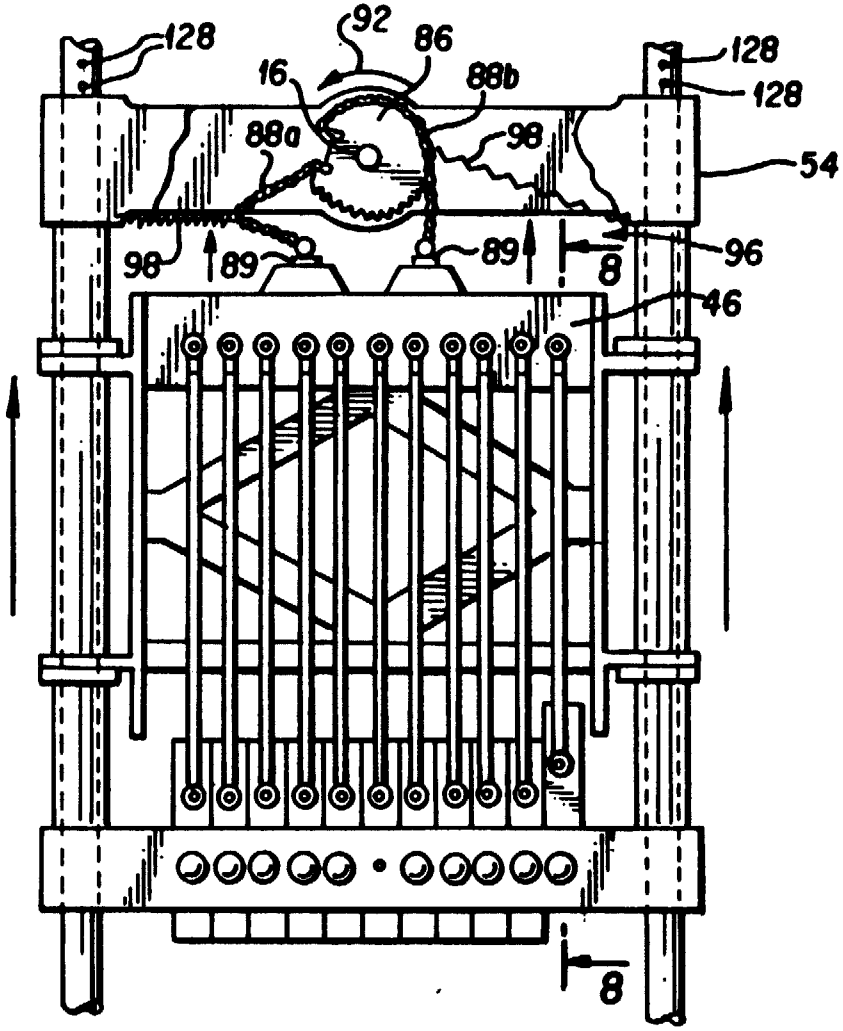
FIG. 5 is a rear view partially in cut-away of the multi-exercise system showing the rotative displacement mechanism in a second position.
Figure 4:
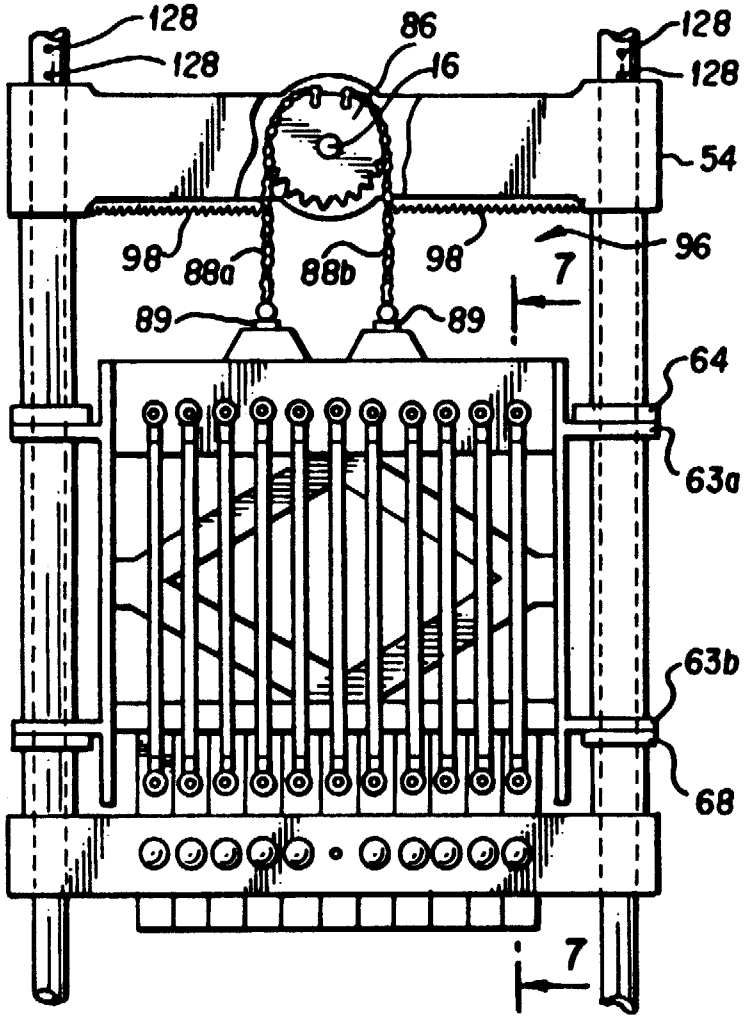
FIG. 4 is a rear view partically in cut-away of the multi-exercise system showing the rotative displacement mechanism in an initial operating postion.

As shown in FIGS. 3, 4 and 5, resistive force mechanism 40 includes resistive force upper carriage or frame member 46 having a plurality of frame tab members 63a,b extending therefrom. Each of the frame tabs 63a,b includes an aperture, having a diameter sufficiently large to permit the respective resistive force tubular members 50 and 52 to pass therethrough. The resistive force upper carriage 46 is provided with a plurality of slide blocks 64, 68 for providing smooth displacement of carriage 46 on tubular members 50 and 52. The upper slide blocks 64 are coupled to the upper frame tabs 63a, and are provided with a through opening formed therein for receipt of a respective tubular member 50 or 52. Likewise, the lower slide blocks 68 are coupled to respective lower frame tabs 63b, and are provided with a through opening for receipt of the respective tubular members 50 and 52. Slide blocks 64 and 68 are formed of a self-lubricating plastic composition. Although in one working embodiment, a nylon plastic composition has been utilized to form the slide block members 64 and 68, other material compositions or roller-type structures may be substituted therefor without departing from the inventive concept, as herein described.

The unit enclosed within housing 62 is releasably secured to base bar frame members 36 and 38 by means of the height adjustment locking system 122, shown in FIGS. 1, 3, 9 and 15. Height adjustment locking system 122 includes a pair of handles 124 and adjustment pins 126. Adjustment pins 126 pass through respective apertures formed in rotative displacement frame member 54 for respective engagement with one of a plurality of through openings 128 formed in respective base bar frame members 36 and 38, as shown in FIGS. 4 and 5. To further aid in the displacement of the unit enclosed by housing 62, a counter balance system 56 is coupled thereto. Counter balance system 56 includes a gas spring 58 having a predetermined spring rate for substantially counterbalancing the weight of the unit enclosed within housing 62, thereby making the displacement thereof substantially effortless.

Of particular importance, is the structure of transmission mechanism 42, providing a substantially linear displacement of resistive force upper carriage 46 with respect to the lower frame member 48. Transmission mechanism 42 includes a rotative displacement mechanism 84 having a rotational axis 16 for rotation responsive to rotative displacement of the actuating bar mechanism 44. The rotative displacement mechanism 84 includes a rotative displacement member 86 fixedly coupled to a shaft 94. Shaft 94 is also fixedly coupled to the disk 104 having a plurality of through openings 108 formed therein in spaced relationship adjacent a perimeter portion of disk 104, for coupling with the actuating bar mechanism 44.

Rotative displacement member 86 is constructed in the form of a sprocket wheel having a plurality of teeth disposed on the perimeter edge thereof. Fixedly coupled to opposing sides of the sprocket wheel 86 there is provided flexible chain members 88a and 88b. Each of chain members 88a and 88b are fixedly coupled to sprocket wheel 86 at an upper portion thereof to provide engagement between the sprocket wheel teeth and a substantial number of chain links. The interface portion of sprocket wheel 86 defining a predetermined interface portion for contiguous contact with respective chain members 88a and 88b. It has been determined that the angular portion of sprocket wheel 86 which is engaged with a respective chain member 88a, 88b be at least 45° to provide displacement of carriage member 46 responsive to rotation of rotative displacement member 86, the displacement of carriage 46 being linear with respect to the angular displacement of sprocket wheel 86, including the critical initial rotative displacement portion of the angular displacement of sprocket wheel 86.

Figure 16:
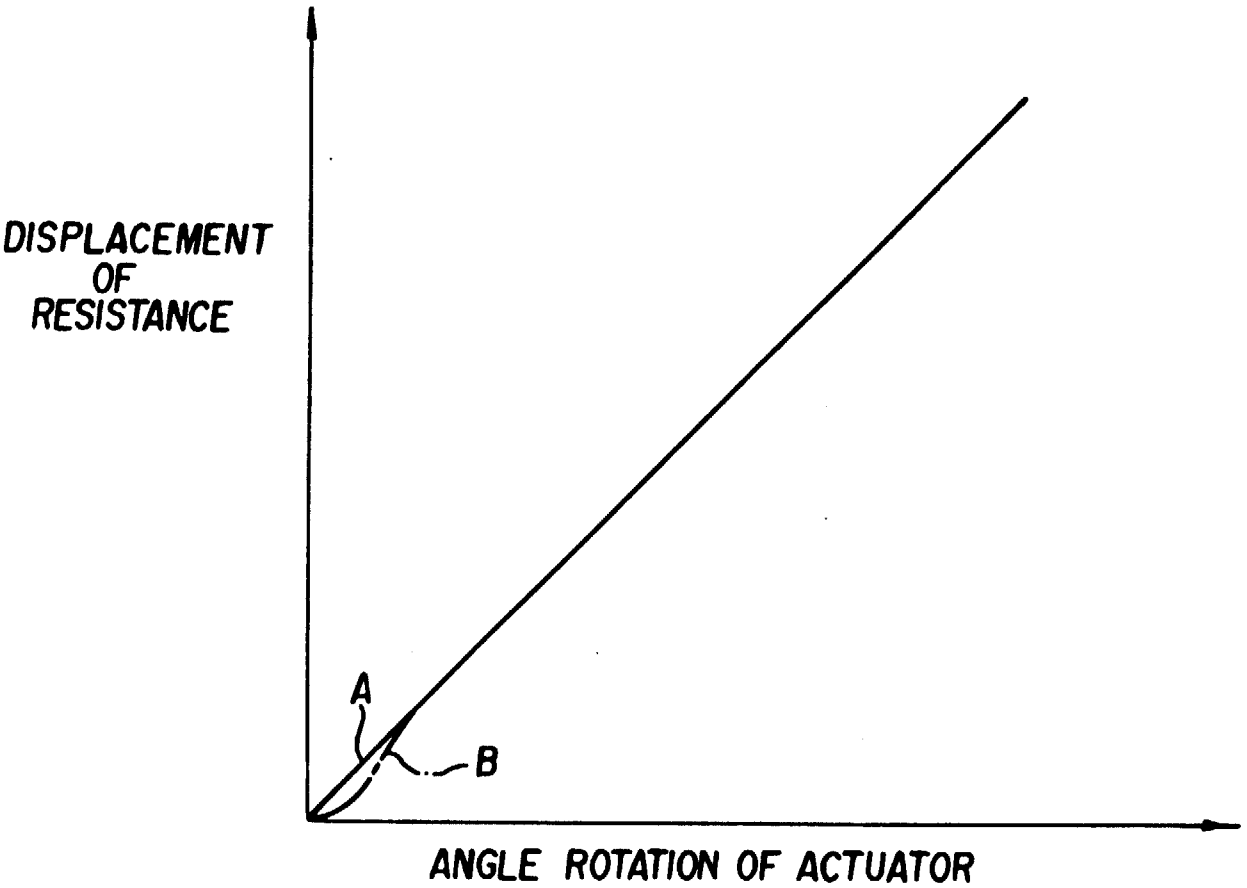
FIG. 16 is a graphical representation illustrating the linear displacement of the resistance elements with respect to the rotative displacement of the actuator.

Referring to the graph of FIG. 16, the improvement provided by the aforementioned arrangement is shown. Graph line B represents prior art systems wherein the initial rotation of the actuator does not provide a one-for-one displacement of the resistive load until a predetermined angular displacement is reached, sometimes referred to as a dead zone. The dead zone found in prior art systems provides for a non-uniform feel in equipment operation which is noticeable to the user and generally undesirable.

Whereas the rotative displacement mechanism 84 whose operation is shown in Graph Line A, provides a one-for-one displacement of the resistance with respect to rotation of the actuator throughout its range of motion, providing the operator with a smooth and uniform feel as the equipment is operated, which is of critical importance to exercise equipment operation.

Resistive force mechanism 40 includes a plurality of resistive force members in the form of elastic cord members 72, releasably coupled between upper carriage 46 and resistive force lower frame member 48. Obviously, resistive force members other than elastic cords could be utilized, all that is required is that a resistive force result from a displacement thereof. Elastic cord members 72 are selectively coupled between carriage 46 and resistive lower frame member 48 based on the user's requirements for a particular exercise. Resistive force mechanism 40 is provided with a plurality of elastic cord members 72 having different incremental force values which are additive by means of the selective mechanism comprising lower frame member 48 and pins 78. As is well known in the art, elastic members exert a varying load force responsive to the amount the cord is stretched. This characteristic of resistive load systems is considered undesirable by many users of exercise equipment. To compensate for this characteristic of the elastic members, the alternate configuration of rotative displacement mechanism 84, shown in FIGS. 14, may be utilized. The sprocket wheel 86' is rotated about an axis 16' which is displaced from the sprocket center 87' by a predetermined distance. This creates an eccentric rotation which changes the rate of displacement of carriage member 46 as sprocket wheel 86 is rotated and the mechanical advantage of the linkage therebetween to thereby compensate for the change in force with respect to displacement of the elastic cord members 72.

Figure 6:
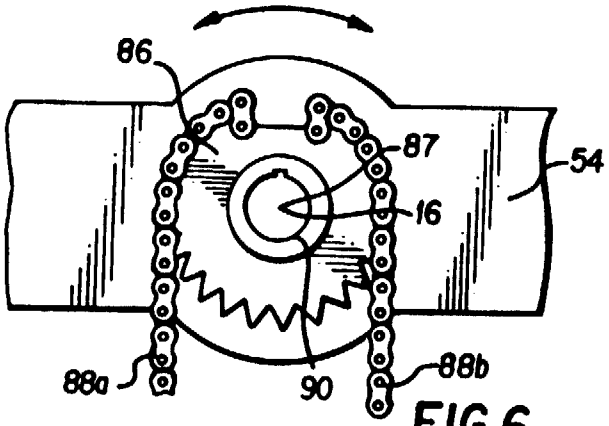
FIG. 6 is a plan cut-away view showing the rotative displacement mechanism.
Figure 9:
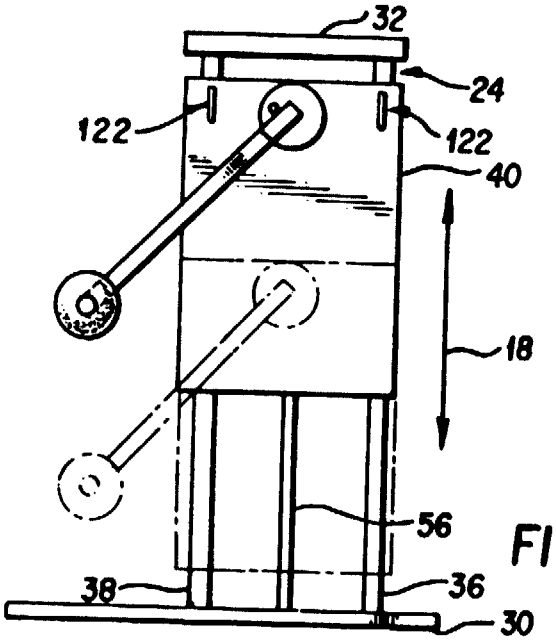
FIG. 9 is a frontal plan view of the mutli-exercise system illustrating the adjustability of the resistive force mechanism with respect to the base frame.
Figure 14:
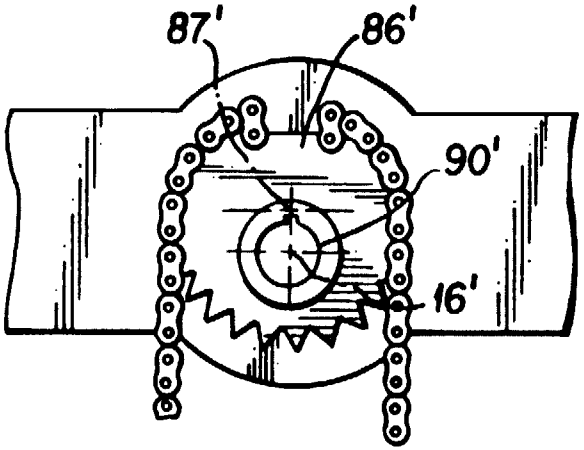
FIG. 14 is a rear view partially in cut-away of an alternate embodiment for the rotational displacement mechanism.

In contrast to the arrangement shown in FIG. 6 wherein the center 87 of sprocket wheel 86 is coincident with the rotative axis 16, the arrangement shown in FIG. 14 substantially maintains the resistive load at a substantially constant value. Without the eccentric operation of sprocket wheel 86 the load can be expected to vary as much as 20% of the total load as the actuator arm is rotated. In contrast, the eccentric speocket wheel 86' provides a resistive load force which varies less than 1% over the distance the actuator arm is displaced. Thereby significantly improving the operation and feel of the equipment.

Referring to FIGS. 4 and 5, there is shown another important feature of rotative displacement mechanism 84. Rotative displacement mechanism 84 includes a tensioning system 96 coupled to each of the flexible members 88*a* and 88*b* for substantially maintaining a predetermined minimum tension on a respective one of the flexible members 88*a*, 88*b* when the rotative displacement member 86 is displaced from a first initial position to a second position in either of two opposite directions.

As shown in FIG. 5, when sprocket wheel 86 is rotated in the direction indicated by arrow 92, the carriage 46 is displaced upwardly by virtue of the chain 88*b* being wrapped about the periphery of sprocket wheel 86. Flexible chain member 88*a* is essentially unwrapped from sprocket wheel 86 and becomes slack. The tensioning system 96 includes a pair of spring members 98. Each of the springs 98 is coupled on one end to the rotative displacement frame member, and on the opposing end to a respective flexible chain member 88*a*, 88*b* for applying an outwardly directed tensile force thereto. Thus, the slackened chain member 88*a*, shown in FIG. 5, is pulled by a spring 98 outwardly toward the spring's attachment point to the frame member 54.

Obviously, when the sprocket wheel 86 is rotated from the initial starting point, shown in FIG. 4, in a direction opposite to that shown in FIG. 5, flexible chain member 88*b* becomes slack and is pulled outwardly by a respective spring 98. The tensioning system 96 prevents the slackened chain from interfering with the upward displacement of the carriage 46, by gathering in the space between sprocket wheel 86 and the chain attachment points 89 of the resistive force upper carriage 46.

The actuating bar mechanism 44 provides a highly adjustable system for adapting to a multitude of exercises. The rotative displacement mechanism includes a coupling disk 102 having a disk pin member 106 for releasable lockable coupling to the disk member 104, the pin 106 being engageable within the plurality of through openings 108 of disk 104. This arrangement provides for the radial adjustment of the actuator with respect to the sprocket wheel 86 to define the initial starting point for rotative displacement of the actuator. The actuator bar 100 is releasably lockingly coupled to the actuating bar coupling 110 by means of an actuating bar pin 116 engageable through coupling 110 and one of a plurality of actuating bar through openings 118 formed in actuating bar 100, as shown in FIGS. 1 and 3.

Figure 13:
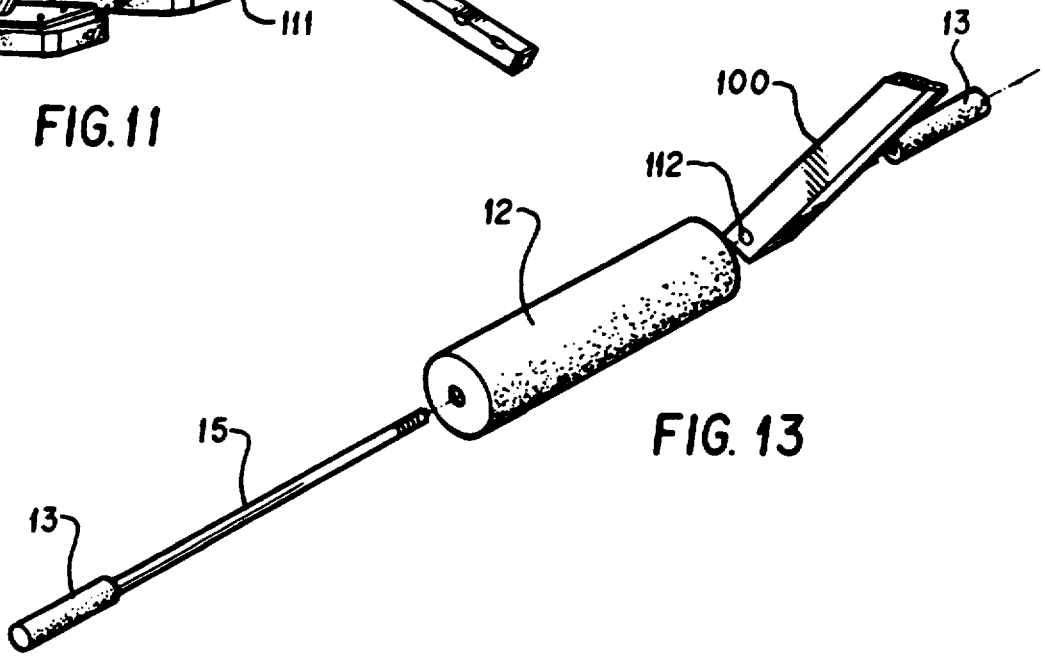
FIG. 13 is a perspective view partially in cut-away showing a third embodiment of the actuating bar mechanism.
Figure 15:
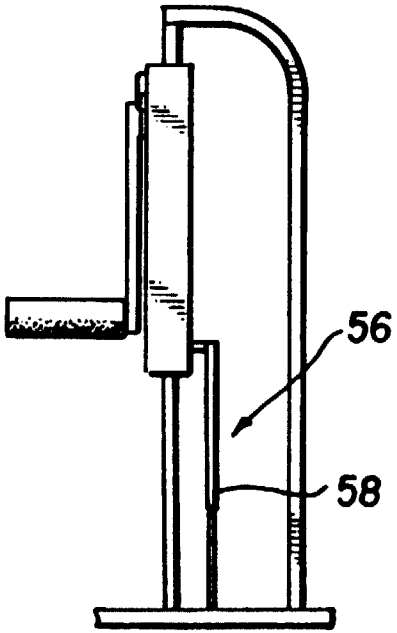
FIG. 15 is an end elevation view of the improved multi-exercise system.

Thus, the locking pin 116 in cooperation with the coupling 110 into which is received the actuating bar 100, provides the means for adjusting the arm length of the actuating bar mechanism 44. As shown in FIGS. 3 and 13, the distal end of actuating bar 100 is provided with a through opening 112 through which a shaft 15 passes. Shaft 15 is adapted for releasably coupling to handles 13 on opposing ends thereof. Between the opposed handles 13 there is provided a pad 12 having a longitudinally extended cylindrical contour, whereby the user can apply the rotative displacement forces to actuating bar 100 by means of handles 13 or pad 12, facilitating the user's hands or legs to displace actuating bar 100.

Figure 12:
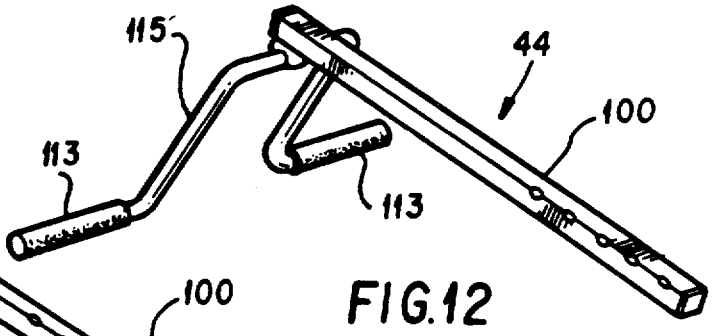
FIG. 12 is an alternate embodiment of the actuating bar mechanism.

Alternately, actuating bar mechanism 44 may be constructed as shown in FIG. 12, wherein a handle bar-like handle frame 115 is coupled to the distal end of actuation bar 100. The opposing ends of the substantially U-shaped handle frame 115 are coupled to handles 113, primarily for use in performing upper body exercises.

Figure 11:
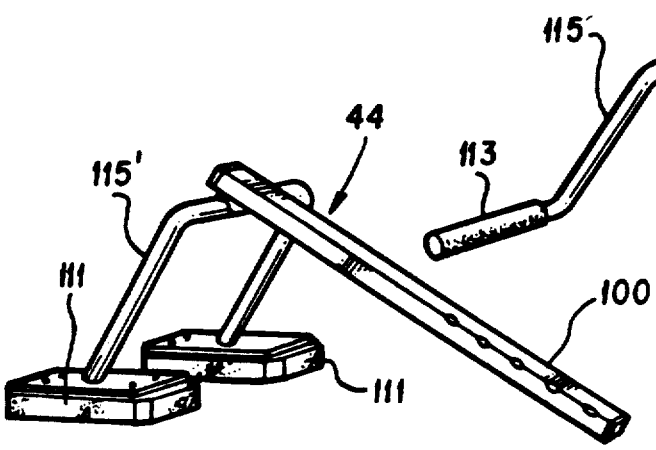
FIG. 11 is a perspective view of one embodiment of the actuating bar mechanism.

As shown in FIG. 11, other attachments may be included for coupling to actuator bar 100. Such attachments may include a substantially U-shaped handle frame 115' coupled on opposed ends to padded paddles 111. As shown in FIG. 10, the actuator bar mechanism 44 may be coupled to the actuation bar coupling 110 for rotative displacement in either of two opposite directions.

Figure 8:
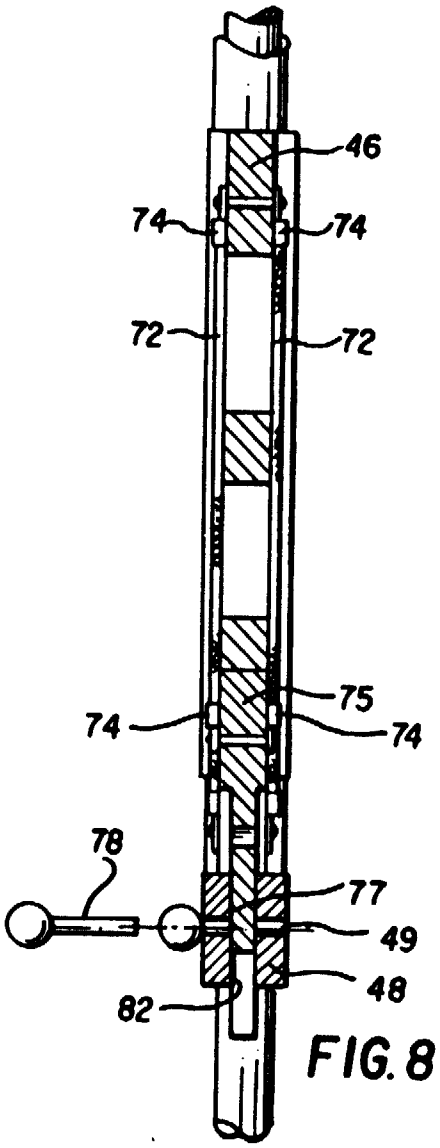
FIG. 8 is a sectional view partially in cut-away of the resistive force mechanism taken along the section line 8—8 of FIG. 5.
Figure 7:
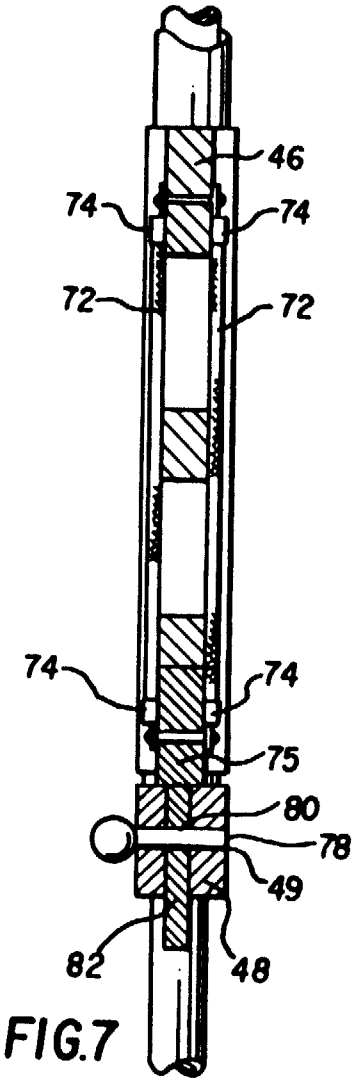
FIG. 7 is a sectional view partially in cut-away of the resistive force mechanism taken along the section line 7—7 of FIG. 4.

Referring now to FIGS. 3, 7 and 8, there is shown the releasable coupling arrangement for the plurality of elastic cord members 72. Each elastic cord 72 is provided with an elastic cord connector 74 on opposing ends thereof, one end of each of the elastic cord members being fixedly coupled to the resistive force upper carriage 46, by means of a fastener coupling the respective elastic cord connectors 74 thereto. Although not important to the inventive concept, elastic cord members 72 are arranged in pairs, coupled on opposing sides of carriage 46. The opposing ends of elastic cord members 72 are each coupled to elastic cord connector blocks 76, by means of fasteners and the elastic cord connectors 74.

Elastic cord connector blocks 76 include a connection block portion 75 for coupling with the connectors 74 and an extended tab portion 77 integrally formed to connector block portion 75. Each pair of elastic cord members 72 are coupled to a respective elastic cord connector block 76, with one of the connector blocks 76 being fixedly coupled to the resistive force lower frame member 48, to provide a minimum resistance load, with the remainder of the plurality of connector blocks 76 being releasably coupled to resistive force lower frame member 48.

Each of the tab portions 77 of the connector blocks 76 extend through a slotted opening 82 formed in lower frame member 48. Each of the tabs 77 may be received within a respective slotted opening (not shown), or a singular elongated slot for receipt of all of the tab members 77 in side-by-side relationship. Each of the tab members 77 are provided with a through opening 80 formed therethrough for receipt of a block pin member 78. Pin members 78 pass through respective openings 49 formed in resistive force lower frame member 48 and the through opening 80 formed in tab 77 to lockingly engage the elastic cord connector block 76 when the resistive force therefrom is desired. When reduced resistive force is required, the pin 78 is withdrawn from the through opening 80 of elastic cord connector block 76, which then may be displaced without exerting any resistive force to the carriage 46.

The tab portions 77 of elastic cord connector blocks 76 are sufficiently long such that when disengaged from the resistive force lower frame member 48, a portion of tab 77 remains within the slotted opening 82 covering the opening 49 through which pin 78 is inserted. Such prevents reinsertion of pin 78 subsequent to displacement of carriage 46, thereby preventing jamming of connector blocks 76 against the pin 78, which would limit the return stroke of the actuating bar mechanism 44. This arrangement, with lower frame member 48 being stationary, in contrast to that of the referenced system disclosed in U.S. Pat. No. 4,666,149, provides by the aforementioned arrangement, a means to select the resistive force load which is maintained in a fixed position. Thereby allowing the movable elements of the mechanism to be shielded by the housing 62, providing added safety to the user.

Referring now to FIGS. 1 and 2, there is shown adjustable seating mechanism 132 included in improved multi-exercise system 10. Adjustable seating mechanism 132 provides for backrest member 134 and seatrest member 136, adjustable in a plurality of positional locations. Adjustable seating mechanism 132 is utilizable by a user in the event the user is performing various exercises from a seated, prone or semi-prone position.

Adjustable seating mechanism 132 is displaceable in horizontal direction 20 with respect to the base frame 24, at the discretion of the user. Adjustable seating mechanism 132 includes a pair of seating floor frame members 138 and a substantially C-shaped seat frame 140, coupled on opposing ends to a respective floor frame member 138. Both backrest 134 and seatrest 136 are coupled to the U-shaped seat frame 140 at a pivot point 144 to allow rotation of the seatrest 136 and backrest 134 about respective pivot points 144.

Backrest 134 and seatrest 136 are rotatable about the respective pivot points 144 by means of respective adjustment bars 146 telescopically extendable from adjustment couplings 142. Each adjustment bar 146 is provided with a plurality of adjustment openings 148 for releasable coupling with a pin 154 extending through adjustment coupling 142, thereby providing the means to angularly adjust the seatrest 136 and backrest 134, at the discretion of the user.

Backrest 134 may include a padded backrest 156 and rigid backrest frame 158 to which the adjustment bar 146 is pivotedly coupled. Similarly, seatrest 136 may include a seatrest padded member 160 which rests upon seatrest structural member 162 to which a respective adjustment bar 146 is pivotedly coupled. In this manner, both backrest 134 and seatrest 136 may be responsively inclined in an individual manner at the discretion of the user.

Although this invention has been described in connection with specific forms and embodiments thereof, it will be appreciated that various modifications other than those disclosed above may be resorted to without departing from the spirit or scope of the invention. For example, equivalent elements may be substituted for those specifically shown and described, certain features may be used independently of other features, and in certain cases, particular locations of elements may be revised or interposed, all without departing from the spirit or scope of the invention as defined in the appended Claims.

What is claimed is:

1. An improved multi-exercise system of the type having at least one resistance element reversibly displaceable responsive to rotative displacement of an actuating bar mechanism, wherein the improvement comprises:

means for bidirectionally coupling said actuating bar mechanism to said resistance element, said bidirectional coupling means including (1) a rotative displacement member coupled to said actuating bar mechanism for rotation about an axis of said rotative displacement member from a first position to either of two oppositely directed second positions responsive to respective displacement of said actuating bar mechanism, and (2) a pair of flexible members fixedly coupled to opposing sides of said rotative displacement member on respective first ends thereof, each of said pair of flexible members having a second end coupled directly to said resistive element, said pair of flexible members extending between said rotative displacement member and said resistive whereby an initial rotative displacement of said rotative displacement member in either of two opposite directions is transformed into a continuous linear displacement of said resistive element responsive to any rotative displacement of said actuating bar mechanism.

2. The improved multi-exercise system as recited in claim 1 where said bidirectional coupling means further includes tensioning means coupled to each of said pair of flexible members for substantially maintaining a predetermined minimum tension on a respective one of said flexible members when said rotative displacement member is displaced to a respective one of said two second positions.

3. The improved multi-exercise system as recited in claim 1 where each of said pair of flexible members is a chain.

4. The improved multi-exercise system as recited in claim 3 where said rotative displacement member is a sprocket wheel having a plurality of teeth formed on a substantial portion of a peripheral edge thereof for engagement with each of said flexible chain members.

5. The improved multi-exercise system as recited in claim 4 where each of said flexible chain members are coupled to said sprocket wheel on an upper portion thereof, thereby defining a predetermined interface portion of said sprocket wheel in contiguous interfacing relationship with each of said flexible chain members when said sprocket wheel is in said first position.

6. The improved multi-exercise system as recited in claim 5 where said predetermined portion is defined by an angular portion of said sprocket wheel of at least 45 degrees.

7. The improved multi-exercise system as recited in claim 1 where said axis of said rotative displacement member is located centrally on said rotative displacement member.

8. The improved multi-exercise system as recited in claim 1 where said axis of said rotative displacement member is located at a position displaced from a central position on said rotative displacement member for maintaining substantially constant a loading force with respect to said linear displacement of said resistance element.

9. An improved multi-exercise system having means for providing a resistive force loading responsive to an applied force by a user, comprising:

a base frame means for coupling said resistive force loading means thereto; and, transmission means coupled to said base frame means for transmitting said user applied force to said resistive loading means, said transmission mans including (1) actuating bar means for displacement responsive to said user applied force, (2) rotative displacement means coupled to said actuating bar means for rotation about an axis responsive to displacement of said actuating bar means, said rotative displacement means including a rotative displacement member coupled to said actuating bar means for rotation about a common axis, and (3) a pair of flexible members fixedly coupled to opposing sides of said rotative displacement means on respective first ends thereof, each of said pair of flexible members having a second end coupled directly to said resistive loading means, said pair of flexible members extending whereby an initial rotative displacement of said rotative displacement means in either of two opposite directions is transformed into a continuous linear displacement of said resistive force loading means responsive to any rotative displacement of said actuating bar means.

10. The improved multi-exercise system as recited in claim 9 where said rotative displacement means includes releasable coupling means for adjustably receiving and reversibly locking said actuating bar means.

11. The improved multi-exercise system as recited in claim 10 where said releasable coupling means includes means for reversibly locking said actuating bar means in any one of a plurality of predetermined longitudinally displaced positions.

12. The improved multi-exercise system as recited in claim 10 where said rotative displacement means further includes radial adjustment means coupled to said releasable coupling means for rotationally adjusting a radial position of said actuating bar means relative to said rotative displacement member.

13. The improved multi-exercise system as recited in claim 9 where said common axis is located centrally on said rotative displacement member.

14. The improved multi-exercise system as recited in claim 9 where said common axis is located at a position displaced from a central position on said rotative displacement member for maintaining substantially constant a loading force with respect to said linear displacement of said resistive force loading means.

15. The improved multi-exercise system as recited in claim 9 where said transmission means includes tensioning means coupled to each of said pair of flexible members for substantially maintaining a predetermined minimum tension on a respective one of said flexible members when said rotative displacement member is displaced in a respective one of said two opposite directions.

16. The improved multi-exercise system as recited in claim 9 where said actuating bar means includes a longitudinally extended bar member coupled to said releasable coupling means on a first end thereof.

17. The improved multi-exercise system as recited in claim 16 where said actuating bar means further includes handle means coupled to a second end of said longitudinally extended bar member.

18. The improved multi-exercise system as recited in claim 17 where said handle means includes:

(a) a shaft member rotatively coupled to said longitudinally extended bar member second end;

(b) a pair of handle grip members releasably coupled to opposing ends of said shaft member; and, (c) a pad member positionally located on said shaft member between said pair of handle grip members.

19. The improved multi-exercise system as recited in claim 9 where said resistive force loading means includes:

(a) a lower frame member coupled to said base frame means, said lower frame member having at least one slotted through opening formed therethrough:

(b) an upper frame member slidingly coupled to said base frame means for linear displacement thereon, said upper frame member being fixedly coupled to sais pair of flexible member second ends;

(c) at least one resistive force member having a first end fixedly secured to said upper frame member;

(d) connection means coupled to a second end of said at least one resistive force member for releasable coupling with said lower frame member through said slotted opening; and, (e) a pin member insertable within a through opening formed in said lower frame member transverse said slotted opening and in open communication therewith.

20. The improved multi-exercise system as recited in claim 19 where said connection means includes (1) a block member coupled to said resistive force member second end, and (2) a longitudinally extended tab member integrally formed with said block member insertable through said slotted opening formed in said lower frame member and having a through opening formed therein for reversible engagement with said pin member, said tab member having a predetermined length dimension whereby said tab member is displaceable within said slotted opening when disengaged with said pin member responsive to said linear displacement of said upper frame member.

* * * * *